United States Patent [19]

Sicoli et al.

[11] Patent Number: 4,466,516

[45] Date of Patent: Aug. 21, 1984

[54] MULTI-PURPOSE SUNBLANKET AND TOTE BAG

[75] Inventors: Robert Sicoli; Frank Sicoli; Eugene Sicoli, all of Belleville, N.J.

[73] Assignee: RVS Enterprises, Belleville, N.J.

[21] Appl. No.: 501,430

[22] Filed: Jun. 6, 1983

[51] Int. Cl.[3] ..... A45G 9/00

[52] U.S. Cl. ..... 190/2; 5/419; 383/4

[58] Field of Search ..... 190/1, 2, 8; 383/4; 5/417, 419, 420

[56] References Cited

U.S. PATENT DOCUMENTS

| | | | |
|---|---|---|---|
| 2,038,335 | 4/1936 | Aronow | 5/419 X |
| 2,264,471 | 12/1941 | Glenn | 5/419 |
| 2,659,404 | 11/1953 | Kelsey | 383/4 |
| 2,898,609 | 8/1959 | Storie | 5/419 |
| 3,237,904 | 3/1966 | Abruzese | 5/417 X |
| 3,477,552 | 11/1969 | Goldman | 190/2 |
| 4,074,740 | 2/1978 | Anderson | 383/4 X |
| 4,097,944 | 7/1978 | Yulish | 5/419 |
| 4,188,988 | 2/1980 | Agyagos | 383/4 |
| 4,195,378 | 4/1980 | Parker | 190/2 X |
| 4,197,891 | 4/1980 | Comollo | 383/4 |

FOREIGN PATENT DOCUMENTS

| | | | |
|---|---|---|---|
| 1044391 | 11/1953 | France | 5/419 |
| 1215109 | 4/1960 | France | 383/4 |

*Primary Examiner*—William Price
*Assistant Examiner*—Sue A. Weaver
*Attorney, Agent, or Firm*—M. K. Silverman

[57] ABSTRACT

There is disclosed a multi-purpose sunblanket and tote bag that is formed of a foldable blanket-like material in the form of a mat. This mat constitutes a substantially rectangular first area having a major axis and a minor axis in which the mat defines at least four substantially equally spaced fold lines disposed transversely to the major axis of the mat. There is also provided a second area of the mat which is integral to the first area thereof and is separated therefrom by one of said spaced fold lines of the first area. The second area of the mat defines a sub-rectangle of about the same area and shape of each of the four sub-rectangles of the first area. Further, fold lines are provided within the sub-rectangle of the second area to define three sub-subrectangles which, when folded, will create like and similar sub-subrectangular folds within the sub-rectangle of the first area.

5 Claims, 14 Drawing Figures

MULTI-PURPOSE SUNBLANKET AND TOTE BAG

BACKGROUND OF THE INVENTION

The enjoyment of a comfortable day on the beach involves overcoming a number of logistical problems. For example, a good deal of paraphernalia must, typically, be brought to the beach, such as beach blankets, pillows, purses, and items normally stored therein. Additionally, one must be concerned with the concealment of ones valuables while swimming, of avoiding loss of important items such as car keys in the sand, and the protection of delicate items such as cameras.

Thusly, it may be appreciated that the number and types of items, packages, and aparatus that a person may be required to carry in order to spend a day on the beach or a part of the day in the sun, usually provides a source of annoyance because of the sheer number and cumbersomeness of the items involved. Moreover, the problem may be compounded even further in those cases where a mother takes a child along, this being because of the numerous articles that must be taken for the infant's needs.

Efforts of the prior art to deal with the above set forth problems have been limited to and, to the Applicant's best knowledge and belief, are reflected in U.S. Pat. Nos. 2,264,471 to Glenn; 3,477,552 to Goldman; 4,188,988 to Agyagos; 4,195,385 to Parker; and 4,197,891 to Comolo. None of said art fully treats the objectives of concern to the Applicant herein.

The most pertinent areas of classification of the present Multi-Purpose Sunblanket and Tote Bag are believed to be U.S. Class 5, Sub-classes 417 and 419; U.S. Class 150, Sub-classes 1.7 and 12; and U.S. Class 190, Sub-class 2.

SUMMARY OF THE INVENTION

The invention relates to multi-purpose beach and recreational equipment and, more particularly, to a multi-purpose sunblanket and tote bag that is formed of a foldable blanket-like material in the form of a mat. This mat comprises a substantially rectangular first area having a major axis and a minor axis in which the mat defines at least four substantially equally spaced fold lines disposed transversely to the major axis of the mat. The fold lines act to define the boundary of four sub-rectangles having substantially equal areas, such sub-rectangles having their major axes transverse to the major axis of the foldable mat; each of said sub-rectangles may be folded upon and within each other in order to form, of said first area, a single fold portion of said mat having substantially the area and shape of a single one of said mat which is integral to said first area and is separated therefrom by one of said spaced fold lines of the first area, the second area defining a sub-rectangle of substantially the same area and shape as each of said four sub-rectangles of said first area. The second area is foldable upon and within the sub-rectangles of the first area of the mat, when the first area is fully folded. The second area includes two fold lines that define three sub-subrectangles that are mutually foldable onto each other. This arrangement permits the folding of the sub-rectangles of the first area onto and against the substantially like area and shape defined by the sub-rectangle of the second area. Further, the fold lines within the sub-rectangle of the second area define three sub-subrectangles which, when folded, will create like and similar sub-subrectangular folds within the sub-rectangles of the first area.

The three sub-subrectangles of the second area are provided with an integral pillow upon one of said three sub-areas, and with multi-pocket, multi-closure structures upon the second and third sub-rectangles thereof. Also provided are means for securing said first and second areas together after they have been folded and reduced into the above set forth sub-subrectangular structure.

Also provided are means for carrying the completely folded and secured mat upon the shoulder of the user. Finally, there are provided means for securing said mat, when in unfolded condition, to the beach as, for example, through the use of an eye and picket structure similar to that used in securing the bottom of a tent to the earth.

Accordingly, it is a principal object of the present invention to provide a means for carrying various beach items which means may, after arrival at the beach or other recreational site, be unfolded to provide a mat or sunblanket.

Another object of the invention is to provide a blanket which may be easily folded into a compact unit in order to facilitate the carrying of the same in the manner of a tote bag.

A further object is to provide a multi-purpose tote bag which can be additionally used as a ground sheet, beach mat, or sunblanket when fully opened.

A yet further object of the invention is to provide an aid to the beach-goer in which, while at the beach, there will be afforded means for the concealment of valuables and the protection of various other items from loss.

A still further object of the invention is to advance the enjoyment of beach-goers and sunbathers through the provision of a single piece of sunbathing equipment which can, in a single unit, perform the functions of transporting and protecting items on the beach and, as well, provide a means for comfortably reclining while on the beach and, thereafter, a means for drying-off after bathing.

The above and other objects and advantages of the invention will become apparent upon a consideration of the following Detailed Description of the Invention and the Claims, these being with reference to the accompanying drawings.

DETAILED DESCRIPTION OF THE INVENTION

Figure 7:
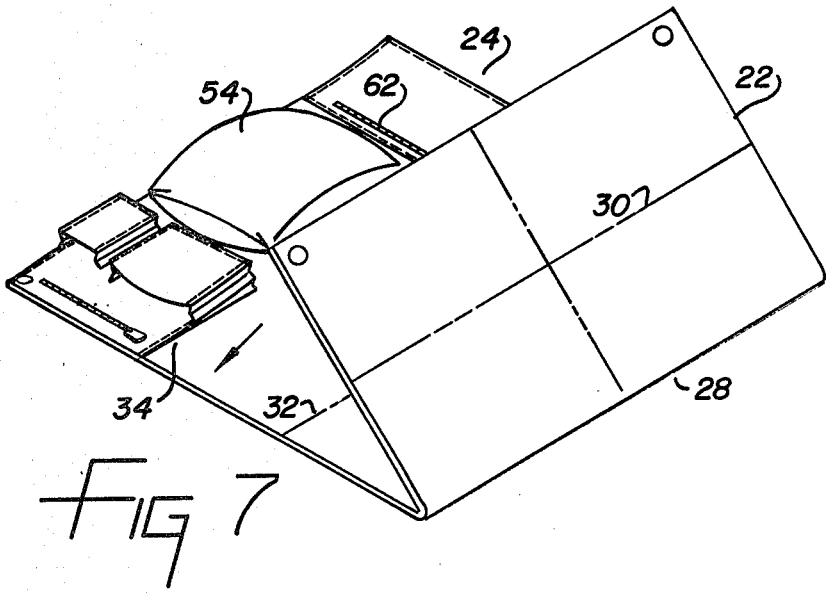
FIG. 7 is a view, similar to that of FIG. 6, however, showing the use of a first fold in the first area of the mat.

Referring now to FIG. 7, a large mat of a blanket-like foldable material 20, approximately seven feet in length by three in width is provided. The mat is constructed of soft, but heavy-duty material, suitable for use as a beach blanket. Further, the mat 20 comprises a first area 22 and a second area 24, said first area having a major axis 26 and a minor axis 28. Said minor axis 28 defines an actual fold line of the first area 22, while the major axis 26 does not correspond to any fold line of the first area but, rather, is purely imaginary in character.

Figure 6:
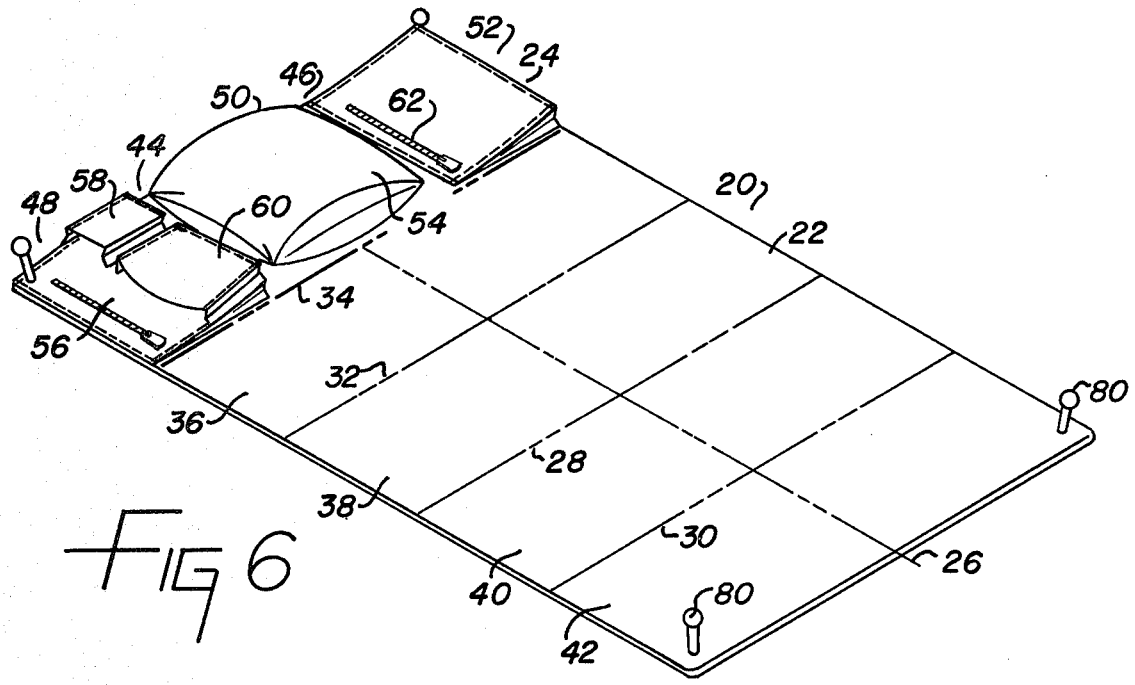
FIG. 6 is the perspective view of the combination sunblanket and tote bag shown in a fully unfolded condition.

The first area 22 of the mat defines a total of at least four substantially equally spaced fold lines 28 (above noted), 30, 32, and 34, said last fold line 32 also defining an interface between the first area 22 and second area 24 of the foldable mat 20. (See FIG. 6).

It is noted that each of said fold lines 28, 30, 32 and 34 are disposed transversely to the major axis 26 of the first area of the mat 22. By virtue of this geometry, said fold lines define four sub-rectangles 36, 38, 40 and 42 each having substantially equal areas, said sub-rectangles further each having their major axes transverse to the major axis 26 of the foldable mat.

As may be noted by the hereinafter described sequence of FIGS. 7, 8 and 9, each of said sub-rectangles 36 to 42 may be readily folded upon and within each other in order to form a single portion of the mat 20, such folded portion having substantially the area and shape of a single one of said sub-rectangles. (See FIG. 9).

Figure 8:
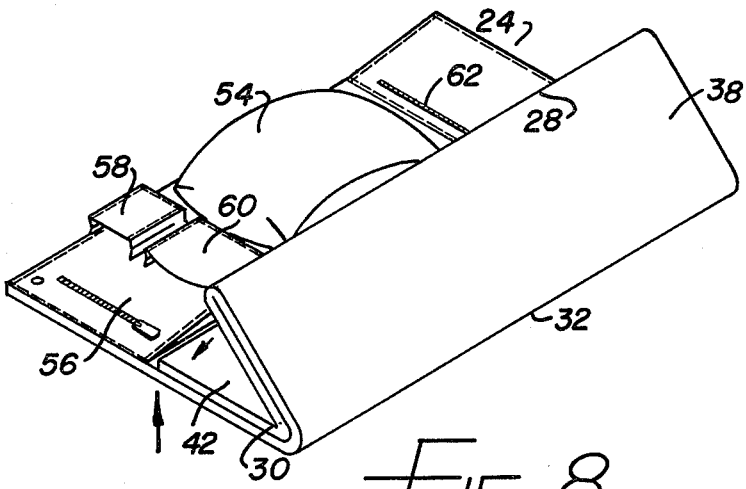
FIG. 8 is a perspective view of the invention, further in "fold sequence" to the view of FIG. 7, showing the existence of a second fold, occurring along two further fold lines within the first area of the mat.
Figure 9:
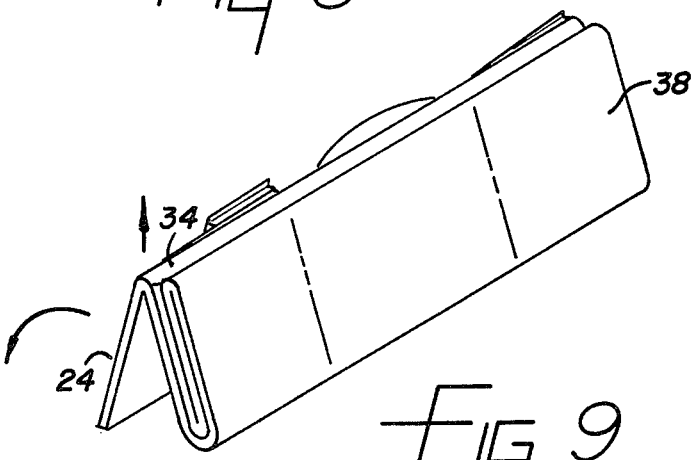
FIG. 9 is a perspective view, further in the "fold sequence" to the view of FIG. 8, showing the existence of a fold line separating the first and second areas of the mat and the relative geometry between the second area of the mat and the first area of the mat after the first area has been fully folded into its sub-rectangular configuration.

With reference to FIGS. 7 to 9, it may be noted that the folded rectangular result of FIG. 9 is obtained through a natural progression of folding of the first area 22 of the mat, beginning with the first fold along line 28 (FIG. 7), and a simultaneous second fold along lines 30 and 32 which is illustrated in FIG. 8. A final fold along line 34 reduces both first and second areas of the mat to a single rectangular shape. (See FIG. 9).

The second area 24 of the mat is, as above noted, integral to said first area 22 and is separated therefrom by the interface of the folded line 34. Said second area defines a sub-rectangle of substantially the same shape and area as the subrectangles 36 to 42; said second area is thereby foldable upon within the sub-rectangular structure of the first area when said first area is fully folded, as is shown in FIG. 9.

The second area further defines two fold lines 44 and 46 (see FIGS. 6 and 10) in order to thereby form three sub-subrectangles 48, 50 and 52. Integrally disposed upon said sub-subrectangles is a pillow structure 54 disposed upon sub-subrectangle 50 and multi-pocket closure structures 56, 58 and 60 disposed upon sub-subrectangle 48 and closure structure 62 disposed upon sub-subrectangle 52. See FIGS. 6 and 8.

Figure 1:
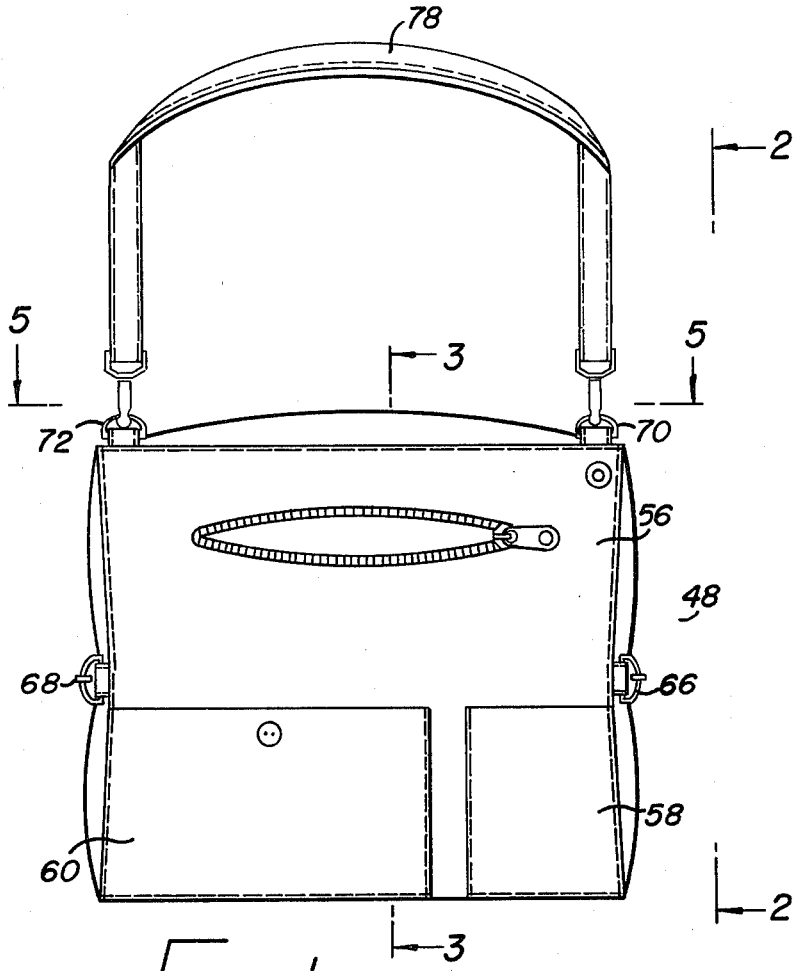
FIG. 1 is a front elevational view of the multi-purpose sunblanket and tote bag completely folded and secured as to its constituent surfaces.
Figure 10:
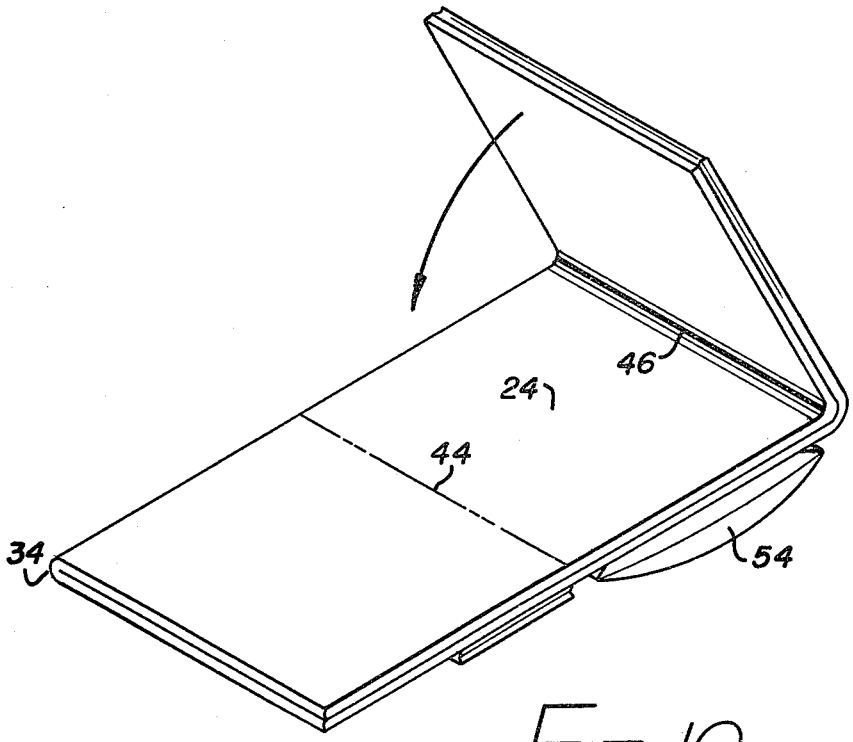
FIG. 10 is a perspective view of the second area of the mat showing the fold lines therewithin and the resultant sub-subrectangular surfaces formed thereby, as well as the integral pillow and multi-pocket structure thereof.
Figure 11:
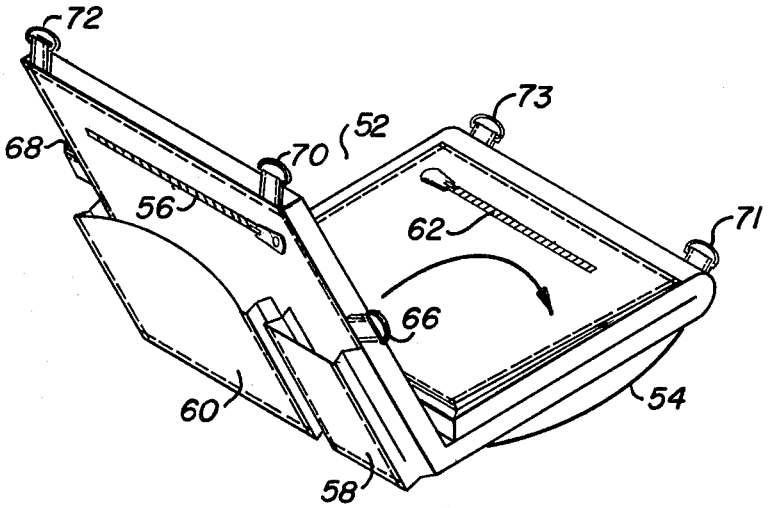
FIG. 11 is a perspective view, further in the "fold sequence" to the view of FIG. 10.

With reference to FIGS. 10 and 11, it may be noted that said structure of sub-subrectangles may be mutually folded upon and within each other in order to fold into a compact arrangement which is illustrated in FIGS. 1 (as to sub-subrectangle 48) and 12 (as to sub-subrectangle 50).

Figure 2:
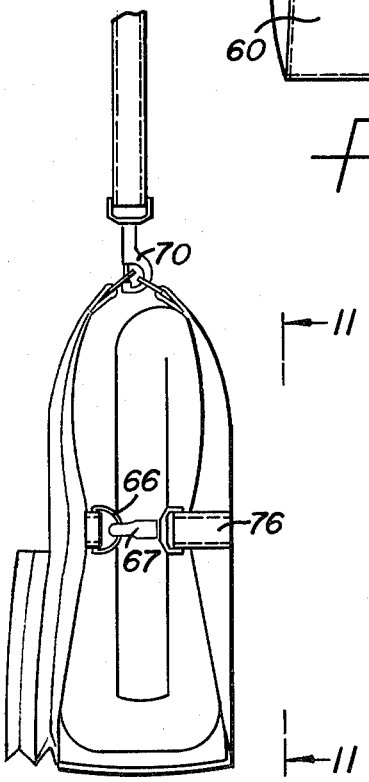
FIG. 2 is a side cross-sectional view of the tote bag taken along line 2—2 of FIG. 1.
Figure 3:
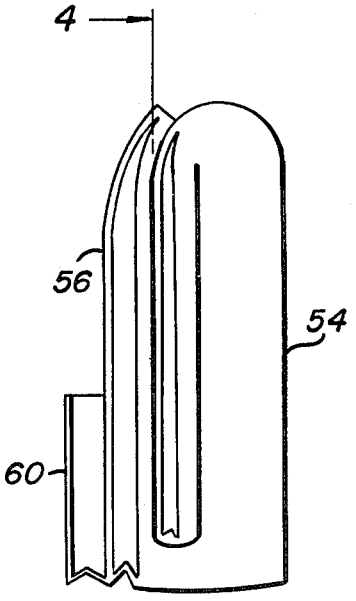
FIG. 3 is a side cross-sectional view of the tote bag taken along line 3—3 of FIG. 1.
Figure 4:
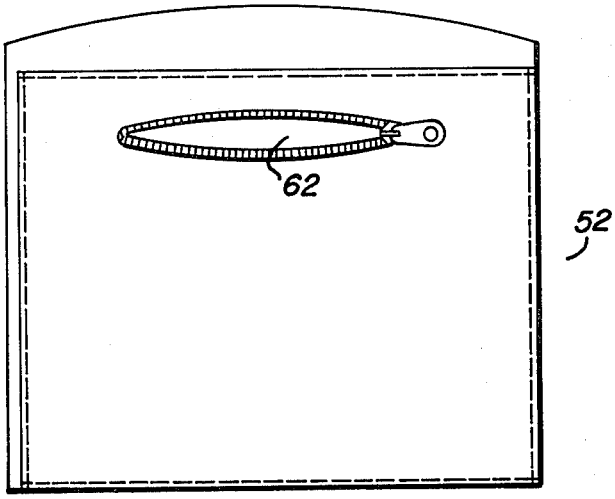
FIG. 4 is a perspective view of the interior sub-subrectangular closure of a second area of the mat of the tote bag.
Figure 5:
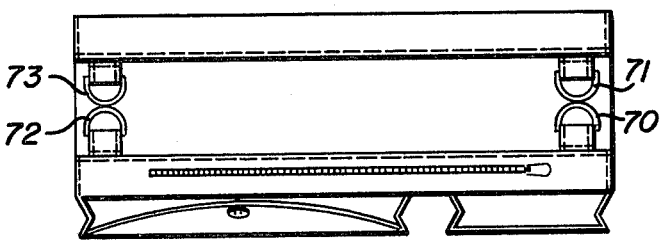
FIG. 5 is a top cross-sectional view taken along line 5—5 of FIG. 1.
Figure 12:
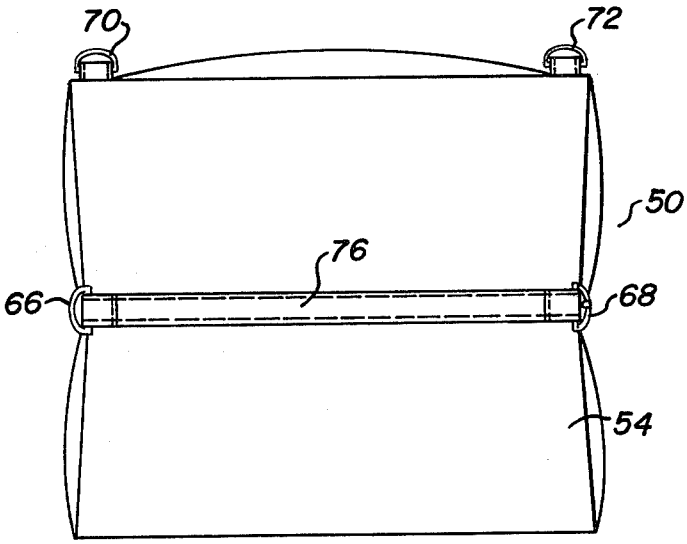
FIG. 12 is an elevational view, showing the opposite side to the view of FIG. 1, however, showing the securement straps and buckles completely in place.

Such compact arrangement is furthered through the use of a buckle structure which, more particularly, involves a first set of medially disposed buckles 66 and 67 and a second set of medially disposed buckles 68 (see FIGS. 2, 11 and 12). Said buckles, in combination with strap 76 (see FIGS. 2 and 12), provide a simple and effective means for the securing of said first and second areas to each other in a closed condition after said first and second areas have been folded into their respective sub-rectangular configurations.

With further reference to FIGS. 1, 2, 11 and 12, it is noted that the present novel structure is provided with a first pair of buckles 70 and 71 and a second pair of buckles 72 and 73 which, in addition to strap 78, comprise a means for carrying the completely folded multipurpose tote bag about the shoulder of a user.

Figure 13:
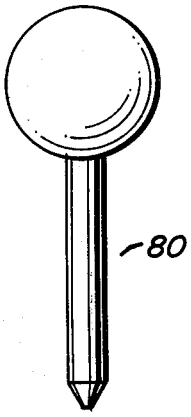
FIG. 13 is a first embodiment of a means for securing the mat, when folded, to the ground.
Figure 14:
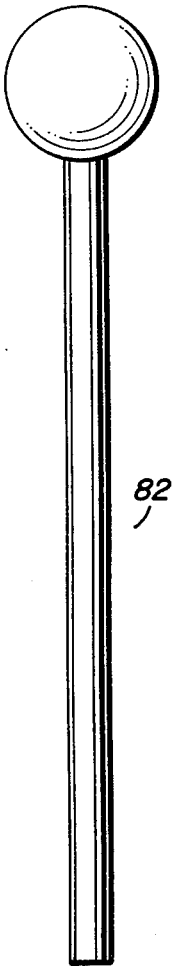
FIG. 14 is a second embodiment of the securing means of FIG. 13, such embodiment being particularly adapted for use on soft surface such as upon a beach.

In FIGS. 13 and 14, there are illustrated two embodiments of means for securing the present foldable mat, when unfolded, to a horizontal earth-like surface. More particularly, a picket 80 (see FIG. 13) having a short stake is provided for attachment of the unfolded mat to a hard surface, while a picket 82 having a long stake (see FIG. 14) is provided for securement of the mat to a soft surface such as a beach.

Accordingly, it may be appreciated that by virtue of the structure above described, there is provided a means for the carrying of various beach items which means may, after arrival at the beach (or other recreational site), be unfolded in order to serve as a mat or sunblanket.

It is to be understood that while there have been shown and described the preferred embodiments of the present invention, the invention may be embodied otherwise than as herein specifically illustrated or described and that, within such embodiments, certain changes in detail and construction, or in the form and arrangement of the parts, may be made without departing from the underlying idea of principles of this invention within the scope of the appended claims.

Having thus described our invention what we claim as new, useful and non-obvious and, accordingly, secure by Letters Patent of the United States is:

1. A multi-purpose sunblanket and tote bag including a mat of a foldable blanket-like material, the tote bag comprising:

(a) a substantially rectangular first area having a major axis and a minor axis, said mat defining at least four substantially equally spaced fold lines disposed transversely to the major axis of the mat, said fold lines defining four sub-rectangles each having areas substantially equal to each other, said sub-rectangles having their major axis disposed transversely to the major axis of the said foldable mat whereby each of said four rectangles may thereby be readily folded upon and in each other such that said first area thereby forms a single fold portion having substantially the area and shape of a single one of said sub-rectangles;

(b) a second area integral to said first area and separate therefrom by one of said spaced fold lines, said second area defining a sub-rectangle of substantially the same area and shape of said four sub-rectangles of said first area, said second area thereby being foldable upon and against the sub-rectangle of said first area when said first area is fully folded along said fold lines, said second area further defining two internal fold lines to thereby form three sub-subrectangles that are mutually foldable onto each other and, as well, onto the folded sub-subrectangles of said first area, thereby permitting the folding of said sub-rectangles of the first area into substantially the same area and shape of the sub-rectangles of said second area, in which said three sub-subrectangles of said second area further comprises a pillow integrally disposed upon one of said sub-subrectangles, pocket means including closing structure, integrally disposed upon said second and third sub-subrectangles of the second area;

(c) means for securing said first and second areas to each other and in a closed condition after said first and second area have been folded into their sub-subrectangular configuration;

(d) means for carrying the completely folded multi-purpose tote bag about the shoulder of the user; and (e) means for securing said mat, when unfolded, to an earth-like horizontal surface, whereby a variety of beach related and personal care items can be disposed within the pockets, and enclosures of said multi-purpose tote bag and, in an unfolded condition, can be used as a beach blanket readily securable to the ground or beach.

2. The multi-purpose sunblanket and tote bag as recited in claim 1 in which said securing means (c) comprises a plurality of buckles and straps.

3. The multi-purpose sunblanket and tote bag as recited in claim 2 in which said carrying means (d) comprises at least one strap and at least two of the buckles also defining said securing means (c).

4. The multi-purpose sunblanket and tote bag as recited in claim 3 in which said means for securing said mat to the earth comprises a plurality of spikes and holes in which said holes are formed at each of the four corners of the entire rectangular mat area as defined by the sum of the first and second areas.

5. The multi-purpose sunblanket and tote bag as recited in claim 4 in which said spikes comprise a combination of a spherical head having a diameter greater than the diameter of the securement holes in said mat and, integrally depending from said spherical head, an elongate element for press-fitting of said spike into the earth, whereby said elongate pole-like element may be shorter in the case of use of the blanket on a hard surface and may be longer in the case of the use of the blanket on a soft surface such as a beach area.

* * * * *